US010239342B2

(12) United States Patent
Fehlmann et al.

(10) Patent No.: US 10,239,342 B2
(45) Date of Patent: Mar. 26, 2019

(54) APPLICATION PEN

(71) Applicant: SIKA TECHNOLOGY AG, Baar (CH)

(72) Inventors: Daniel Fehlmann, Uerkheim (CH); Dana Maiwald, Zurich (CH); Dominique Burkard, Gretzenbach (CH)

(73) Assignee: SIKA TECHNOLOGY AG, Baar (CH)

( * ) Notice: Subject to any disclaimer, the term of this patent is extended or adjusted under 35 U.S.C. 154(b) by 367 days.

(21) Appl. No.: 14/803,395

(22) Filed: Jul. 20, 2015

(65) Prior Publication Data

US 2016/0075168 A1 Mar. 17, 2016

(30) Foreign Application Priority Data

Jul. 25, 2014 (EP) ..... 14178613

(51) Int. Cl.
*B43K 8/02* (2006.01)
*A46B 11/00* (2006.01)
(Continued)

(52) U.S. Cl.
CPC ..... *B43K 8/024* (2013.01); *A46B 11/0003* (2013.01); *A46B 11/0013* (2013.01); *B05C 17/002* (2013.01); *B05C 17/10* (2013.01)

(58) Field of Classification Search
CPC . B43K 8/024; A46B 11/0003; A46B 11/0013; B05C 17/002; A45D 34/045
(Continued)

(56) References Cited

U.S. PATENT DOCUMENTS 2,642,065 A * 6/1953 Negri ..... A61F 11/00 206/222
4,304,869 A * 12/1981 Dyke ..... A61M 35/006 206/219
(Continued)

FOREIGN PATENT DOCUMENTS

EP 0 821 195 A2 1/1998
WO WO 95/03734 A1 2/1995
(Continued)

OTHER PUBLICATIONS

European Search Report dated Jan. 9, 2015.
(Continued)

*Primary Examiner* — David P Angwin
*Assistant Examiner* — Bradley S Oliver
(74) *Attorney, Agent, or Firm* — Buchanan Ingersoll & Rooney PC

(57) ABSTRACT

The invention relates to an application pen for dispensing a liquid onto a surface, such as for applying a protection layer onto adhesion surfaces of a vehicle; for example, for improving adhesion in the case of adhesive applications, the application pen including a hollow body and an ampoule which is received in the hollow body, including a circumferential face, for receiving the liquid, wherein the ampoule can be broken for discharging the liquid, wherein a breaking device with an axially movable portion is provided and is realized in such a manner that a movement of the movable portion in the axial direction results in the breaking of the ampoule.

19 Claims, 7 Drawing Sheets

(51) Int. Cl.
*B05C 17/00* (2006.01)
*B05C 17/10* (2006.01)

(58) Field of Classification Search
USPC ..... 401/123, 130, 132–135
See application file for complete search history.

(56) References Cited

U.S. PATENT DOCUMENTS 4,781,484 A * 11/1988 Goncalves ..... A45D 34/045 401/129
4,784,506 A * 11/1988 Koreska ..... A45D 34/04 401/132
4,957,385 A * 9/1990 Weinstein ..... A61M 35/006 206/530
5,137,387 A 8/1992 Byrd et al.
5,445,462 A 8/1995 Johnson et al.
5,636,931 A * 6/1997 Gueret ..... A45D 40/265 401/126
5,951,186 A * 9/1999 Lhuisset ..... A45D 34/043 401/100
6,004,057 A * 12/1999 Fulop ..... B43K 27/08 401/17
6,047,865 A 4/2000 Shervington et al.
6,425,704 B2 * 7/2002 Voiers ..... B65D 83/00 401/134
6,776,549 B2 * 8/2004 Gueret ..... A45D 34/045 401/126
6,945,723 B1 * 9/2005 Gueret ..... A45D 33/02 401/122
7,252,091 B1 * 8/2007 Wayne ..... A45D 34/04 132/112
8,118,766 B2 * 2/2012 Davis ..... A61M 35/006 401/135
9,089,870 B2 * 7/2015 Frazier ..... B05C 17/00
2001/0031170 A1 10/2001 Voiers et al.
2002/0012563 A1 * 1/2002 May ..... B65D 25/08 401/132
2002/0076258 A1 * 6/2002 Crosby ..... A61M 35/003 401/205
2002/0172541 A1 * 11/2002 Gueret ..... A45D 34/045 401/130
2002/0176732 A1 * 11/2002 Quintero ..... B65D 83/00 401/132
2006/0039742 A1 * 2/2006 Cable, Jr. ..... A61M 35/003 401/134
2006/0228159 A1 * 10/2006 Phillips ..... A46B 17/02 401/132
2007/0292195 A1 * 12/2007 May ..... A45D 34/04 401/134
2014/0003858 A1 * 1/2014 Frazier ..... B05C 17/00 401/133
2014/0301765 A1 * 10/2014 Maiwald ..... A61M 35/006 401/132
2015/0174604 A1 * 6/2015 Jurcevic ..... B05C 17/0052 222/113

FOREIGN PATENT DOCUMENTS

WO WO 01/51360 A2 7/2001
WO WO 2014/004521 A1 1/2014

OTHER PUBLICATIONS

Written Opinion.
Office Action (Communication) dated Apr. 20, 2017, by the European Patent Office in corresponding European Patent Application No. 14178613.7, and an English Translation of the Office Action. (11 pages).

* cited by examiner

APPLICATION PEN

TECHNICAL SCOPE

The invention relates to an application pen for dispensing a liquid onto a surface, preferably for applying a protection layer onto adhesion surfaces of a vehicle, in particular for improving adhesion in the case of adhesive applications, said application pen including a hollow body, in which the liquid is received, preferably inside an ampoule which is received in the hollow body and can be broken for discharging the liquid.

PRIOR ART

Pre-treatment agents for generating adhesive connections are usually provided in packages which consist of an aluminium bottle, polyethylene cup and a screw-type closure of the bottle produced from polyethylene. In the area of single-use applications, aluminium tubes or primer pens and activator pads, in each case with very little contents, are also provided.

Application pens of the above-described type are known, for example, from WO 2014/004521 A1. WO 2014/004521 A1 describes an application pen, including a cylindrical body in which a glass ampoule is held, an applicator part by means of which the liquid can be applied onto a surface as well as a closure cap. The ampoule is destroyed as a result of pressure being exerted radially onto the circumferential face of the applicator part such that the liquid is discharged from the ampoule. The applicator part includes a porous body for applying the liquid. A seal between the individual parts (cylindrical basic body, applicator part and cap) is effected by means of a press fit. Overall, in the case of the application pen according to WO 2014/004521 A1 there is the risk of the liquid drying such that said application pen can only be used multiple times (over a fairly long time period) with difficulty. In addition, the manner of the breaking of the ampoule is conceived as comparatively complicated and not very "intuitive".

The object underlying the invention, consequently, is to provide an improved application pen of the generic type which, in particular, is able to be used multiple times over a fairly long period of time and is simple to operate.

DISCLOSURE OF THE INVENTION

Said object is achieved in particular by an application pen with the features of Claim 1.

In particular, the object is achieved by an application pen for dispensing a liquid onto a surface, preferably for applying a protection layer onto adhesion surfaces of a vehicle, in particular for improving adhesion in the case of adhesive applications, said application pen including a hollow body for receiving the liquid in particular inside an ampoule (including a circumferential face) which is received in the hollow body, wherein the ampoule can be broken for discharging the liquid.

According to a first independent aspect, a breaking device with an axially movable portion is provided and realized in such a manner that a movement of the movable portion in the axial direction results in the ampoule being broken. As a result, an intuitively easily understandable, simple and effective possibility for breaking the ampoule is created. The prior art proposes breaking devices which require force to be applied in a radial manner (for example as a result of crushing against a table edge or pressing in the circumferential face), which is conceived as comparatively complex and complicated. According to the invention, however, a breaking of the ampoule can be achieved in a comparatively simple manner as a result of introducing force in an axial manner (for example as a result of an impact onto an end of the application pen or as a result of a rotational drive by means of a thread, as explained in detail further below). An "axial" movement or introduction of force is to be understood as a movement or introduction of force in the direction of the longitudinal axis of the application pen.

According to a second independent aspect (which can preferably be combined with the first aspect), the hollow body comprises at least two parts, preferably at least three parts, wherein a sealing ring, in particular a sealing lip, is provided on at least one face, in particular a circumferential face, of one of the parts, which is facing a face, in particular a circumferential face, of a further part. The sealing ring, in particular the sealing lip, is preferably integrally moulded on one of the facing faces. A "sealing ring" should provide a structure which is closed per se. A "sealing lip" is preferably a "sealing ring" which is realized as am annular lamella. A core concept of the second aspect consists in providing at least one sealing ring, which simplifies sealing of the individual constituent parts of the application pen. In particular, when the individual parts are movable (such as, for example, a closure cap in relation to a head part or a head part in relation to a base part, for example for breaking the ampoule), a high level of tightness is made possible with at the same time a comparatively simple relative movement.

Overall, it is possible for more than one sealing ring, for example at least two, preferably at least three or four sealing rings (sealing lips) to be provided on one of the facing faces. For example, several sealing rings (sealing lips) can be provided on an outer circumferential face of a head part, a first group of sealing rings facing an inner face of a closure cap and a second group of sealing rings facing an inner circumferential face of a base part.

According to a third independent aspect of the invention (which can preferably be combined with the first and/or second aspect), the hollow body includes at least one closure cap as well as a basic body, which preferably includes an end of the application pen which is remote from the closure cap, wherein the closure cap includes a liquid applicator part (in particular a liquid applicator felt), wherein the closure cap together with the liquid applicator part can be removed from the basic body, wherein the liquid applicator part, in the removed state of the closure cap, can be placed onto the surface, onto which the liquid is to be applied, for discharging the liquid. A core concept of the third aspect consist in that a liquid applicator part is arranged inside the closure cap and consequently the closure cap serves at the same time as a device for applying the liquid. In the prior art, for example in WO 2014/004521 A1, the liquid applicator part remains in the main body of the pen. The result of this is that when the liquid applicator part dries up, either the entire application pen has to be disposed of or (if this is at all possible) the liquid applicator part has to be removed as such out of the application pen, which is linked to a corresponding risk of contamination for the user. In contrast, the invention according to the third aspect allows for the cap including the liquid applicator part to be exchanged as one unit. As the cap represents only a relatively small or simply producible component, it is linked to only small costs and a slight impact on the environment. This generally results in the application pen being able to be used multiple times within a fairly long period of time.

According to a fourth independent aspect of the invention (which can preferably be combined with the first and/or second and/or third aspect), the hollow body comprises at least one basic body and one head part, wherein the head part includes a (flexible) end face with a slot. The width of the slot can be no larger than 1 mm, preferably 0.5 mm, even further preferably no larger than 0.2 mm. In addition, the length of the slot can be at least 1.5 mm, preferably at least 2 mm or no longer than 10 mm, preferably no longer than 5 mm. A core concept of the fourth aspect consists in demonstrating an application possibility according to the "baby bottle" principle. In addition, a, where applicable transparent, closure cap can be provided. The head part can be produced from a (soft) plastics material, for example polyolefin (e.g. polyethylene and/or polypropylene) or from silicon. The head part is preferably realized such that it can be pressed-in in its front region such that the liquid can be dosed and applied as a result. The head part preferably does not comprise any felt and is therefore realized in a "felt-less" manner.

In a preferred development, the movable portion is arranged and realized in such a manner that it can be moved in the axial direction as a result of an impact that is carried out in the axial direction onto an end of the application pen such that the ampoule breaks. The "impact" can be directed for example onto an end of the application pen which is located opposite the outlet region. The "impact" is preferably effected, however, onto an end at which the outlet region is arranged, for example onto a closure cap or a head part. An "impact" is to be understood in particular as a preferably short-term application of pressure, e.g. lasting less than 0.1 s.

In an alternative further development, the movable portion can be driven as a result of rotation of a rotatable portion, in particular of a closure cap, such that a rotation of the rotatable portion drives the movable portion in the axial direction such that the ampoule breaks. The rotatable portion can be realized by the movable portion itself (at least in part). A corresponding rotary drive can be realized, for example, by a thread (screw-type thread). If the user then rotates the movable portion (or the rotatable portion) of the application pen, which is operatively connected to the movable portion, he drives the movable portion in the axial direction at the same time until the ampoule breaks. It is particularly preferred in this context when a closure cap can also be removed from the remaining components of the application pen by means of the same thread. For example, the movable portion (e.g. a head part) can be connected (operatively connected) to the closure cap. By means of a rotation of the closure cap, the movable portion can then be moved in the axial direction toward the ampoule such that said ampoule breaks. Once the ampoule has been broken, the closure cap can then be rotated in the opposite direction such that the closure cap can be removed from the remaining component parts of the application pen. All in all, a simple possibility for breaking the ampoule, which can be carried out without any great effort, is demonstrated by these types of measures.

The breaking device preferably includes a deflecting device in such a manner that a force which acts axially on account of the movement of the movable portion is deflected in the direction of the circumferential face of the ampoule (for breaking the ampoule). In the case of an embodiment of this type therefore, on the one hand it is possible to break the ampoule by means of an axial movement (for example an impact from the front or the back) and this is combined in a synergistic manner such that by means of the deflecting device a force, which acts on account of the axial movement, is directed onto the circumferential face of the ampoule such that the ampoule is able to be broken with comparatively little expenditure of force.

In a concrete embodiment, the breaking device includes at least one (preferably flexible) claw, preferably in such a manner that at least one claw is driven against the circumferential face of the ampoule as a result of the axial movement of the movable portion. As a result of this type of claw, the ampoule is able to be broken with comparatively little effort, which improves the operability of the application pen.

The hollow body preferably comprises a head part and a basic body which includes an end remote from the outlet region. The head part is preferably movable in the axial direction in relation to the basic body. In said embodiment, the head part can define the movable portion or can realize at least part of the movable portion. In addition, the head part can realize at least one component part of the breaking device.

In a concrete development, the head part is guided at least in portions inside the basic body. In a preferred development, the head part can comprise the above-described claw. The head part (just as the basic body) can be realized at least in portions in a cylindrical manner. The operability of the application pen is improved in particular when a relative movement between the head part and the basic body is utilized in order to break the ampoule (e.g. when an axial impact is presented).

In one embodiment, a head part (in particular the above-described head part) can comprise at least one (porous) liquid absorption body, in particular at least one absorption sponge and/or one liquid applicator felt for applying the liquid. In the case of said embodiment, a closure cap, for example, is removed from the unit made up by the basic body and the head part such that a liquid applicator felt (in particular the liquid applicator felt) is accessible to the outside for applying the liquid. The absorption sponge can provide for absorbing vibrations during transport and, as a result, the ampoule is protected. In addition, it can provide for not allowing glass splinters to emerge in the front region when the ampoule is broken. All in all, the operability is simplified and injuries prevented as a result.

The hollow body, (in particular a basic body of the hollow body), preferably comprises at least one run-up inclination on an inner circumferential face in such a manner that an axially acting force is converted, at least in part, into a radially inwardly directed force (directed onto the outer circumferential face of the ampoule). The run-up inclination preferably interacts with the claw which is described further above. Said claws, in turn, can also comprise a corresponding run-up inclination. All in all, a preferred embodiment is developed such that a run-up inclination of a claw interacts with a run-up inclination of the basic body such that an axial displacement of the claw in the direction of a rear end of the application pen forces the claw radially inward such that it presses against the ampoule and breaks it. All in all, a structurally simple solution to break the ampoule in a reliable manner is demonstrated as a result.

In a concrete embodiment, a (removable) foil element, in particular a label, can be arranged around the application pen. The foil element can preferably be arranged around a/the head part and/or between a/the closure cap and a/the basic body. The foil element can be realized such it blocks an axial movement between the head part and the basic body such that—as long as the foil element is attached—the ampule is not able to be broken. In the case of a concrete application, the foil element is then removed, as a result of which the blocking provided by the foil element is eliminated and the ampoule can be broken. If, for example, the foil element (label) is inscribed in a corresponding manner, intuitive and simple operation of the application pen can be achieved.

Generally speaking, the hollow body can comprise different parts, in particular a basic body, preferably including an end of the application pen remote from the outlet region and/or a head part (for example adjoining the basic body) and/or a closure cap.

A liquid applicator part (in particular a liquid applicator felt) and/or sponge (absorption sponge) which prevents glass splinters of the ampoule escaping to the outside can be arranged inside the hollow body, as component parts of the application pen.

The liquid applicator part, in particular the liquid applicator felt, can protrude at least in part from the closure cap, in particular by at least 2 mm or at least 4 mm. As a result, the liquid applicator part, in particular the liquid applicator felt, is accessible in a simple manner from the outside such that liquid can be applied onto a surface.

The liquid applicator part can be connected (where applicable in a fixed and/or integral manner) to the cap, in particular plugged in and/or pressed in and/or glued on and/or welded on.

An end of the closure cap remote from the liquid applicator part can comprise a recess. Said recess comprises, for example, a diameter of at least 0.5 cm and/or no larger than 1 cm and can comprise, for example, a round cross section. The closure cap can be gripped particularly easily as a result of a recess of this type such that the closure cap is able to be removed in a simple manner and in particular is able to function in a simple manner as a device for applying the liquid (with an integrated liquid applicator part). Operability is improved as a result.

The closure cap can comprise axially extending ribs on its outer circumferential face. The operability of the cap, in particular when it functions as an applicator device for the liquid (with an integrated liquid applicator part) is also improved as a result.

According to an independent aspect of the invention, a closure cap for an application pen, in particular of the afore-described type, is proposed, wherein the closure cap comprises an, in particular porous, liquid applicator part, preferably a liquid applicator felt.

DESCRIPTION OF THE DRAWINGS

Advantages and expediency of the invention become clear from the following description of preferred exemplary embodiments by way of the figures, in which:

FIG. 1 shows a schematic section of a first embodiment of an application pen. The application pen includes a base 10, an (axially movable) head part 11 (which realizes a movable portion) and a closure cap 12. The basic body 10, head part 11 and closure cap 12 define a hollow body 3. The basic body 10 comprises an end 14 of the application pen remote from the outlet region 13 (rear end). An ampoule 15 (shown by the broken lines) is arranged in the hollow body 13, specifically inside the basic body 10 and (partially) inside the head part 11. A sponge 16, which prevents the ampoule (or splinters thereof) being able to fall out of the application pen, is additionally provided. The sponge 16 is provided inside the head part 11. A liquid applicator felt 17 is arranged partially inside the head part 11 and the closure cap 12 according to FIG. 1. The ampoule 15 can be broken by means of claws 18 (in the present example four claws are provided but this number is not compulsory) such that liquid is discharged from the ampoule.

The breaking of the ampoule is illustrated in particular in FIGS. 2 and 3. FIGS. 2 and 3 show an enlarged detail of the embodiment according to FIG. 1 in a first position (FIG. 2) and a second position (FIG. 3). It can be seen in FIG. 2 that an end stop 19 of the head part 11 is removed from an end stop 20 of the basic body 10 such that the head part 11 and base part 10 can be moved toward one another, which is symbolized by the arrows 21. If an impact is then exerted in the direction of the arrows 21 onto an end 22 of the application pen which is assigned to the outlet region 13 and in the present case is formed by the closure cap 12, the head part 11 including the cap 12 is displaced in the direction of the basic body 10. The end state is shown in FIG. 3. During said movement, run-up inclinations 23 of the claws 18 come into contact with a (ring-shaped circumferential) run-up inclination 24 of an inner circumferential face of the basic body such that the (flexible) claws are bent inward (in the radial direction) such that pressure is exerted onto the ampoule and it breaks (see FIG. 3). The impact necessary to break the ampoule can be effected, for example, as a result of the basic body 10 being gripped and the cap 12 being pushed (struck) head-on against a wall.

In order to make it easier for the claws 18 to be able to bend radially inward, they are spaced apart from one another by slots 25.

Figure 3:
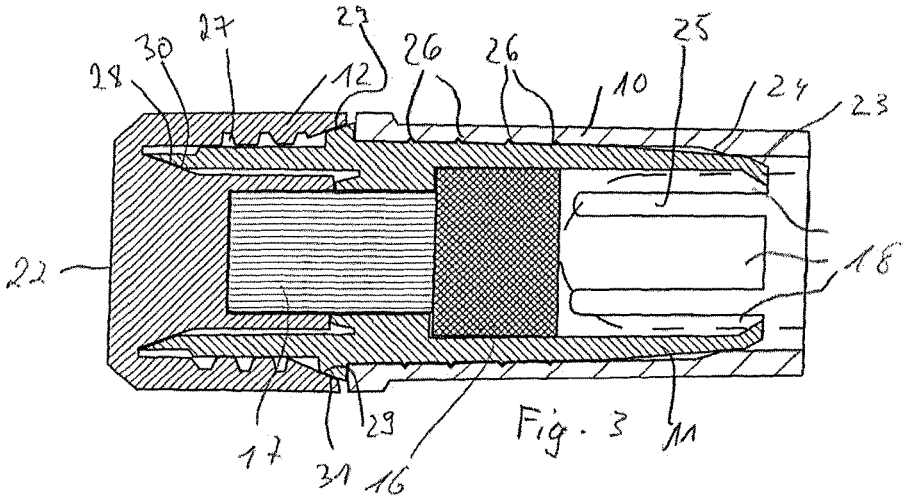
FIG. 3 shows the detail according to FIG. 2 in different position.

Sealing between the basic body 10 and the head part 11 (see FIG. 3) is effected by means of sealing rings 26 which are provided on an outer circumferential face of the head part 11 which is located opposite an inner circumferential face of the basic body 10. Said sealing rings 26 achieve a high level of tightness without the mobility between the head part 11 and the basic body 10, which is necessary for breaking the ampoule, being excessively restricted. The cap 2 can be screw-connected to the head part 11 by means of a screw-type thread 27 (the associated thread of the head part cannot be seen in the Figure as it is realized in an interrupted manner and the interruptions are in the section plane). Sealing of the closure cap 12 in relation to the head part 10 is effected by a cone portion 28 on the closure cap 12 and a cone portion 29 on the head part 11. In addition, the head part 11 comprises an annular inclined face 30 which corresponds with the cone portion 28 of the closure cap 12. In a similar manner, the cap 12 includes an annular inclined face 31 which corresponds with the cone portion 29 of the head part 11. All in all, reliable sealing of the head part 11 in relation to the cap 112 is realized as a result.

Figure 4:
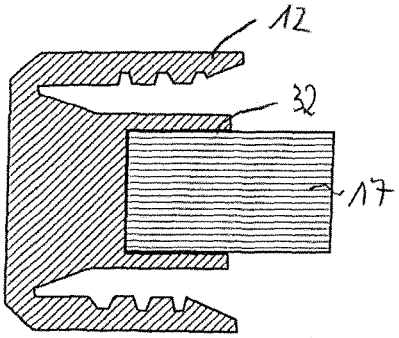
FIG. 4 shows a schematic sectional view of a closure cap of the embodiment according to FIG. 1.

In FIG. 4 the cap 12 is shown without the head part 11 or the basic body 10. As can be seen from FIG. 4, the liquid applicator felt 17 is arranged in a recess 32 of the cap (for example glued on or welded on or integrally moulded in another manner; where applicable, it is also possible for the liquid applicator felt 17 to be detachable from the cap). If, therefore, the cap 12 is removed from the remaining components of the application pen, the cap 12 still comprises the liquid applicator felt 17 associated with it, which is saturated with liquid on account of its previous contact with the sponge 16. Said liquid in the liquid applicator felt 17 can then be applied onto a surface. If the liquid applicator felt 17 has dried out or is no longer usable for another reason, the cap 12 can be thrown away and replaced by a new cap 12. In this case, the remaining components of the application pen can continue to be used. This increases the service life of the application pen in a considerable manner.

Figure 1:
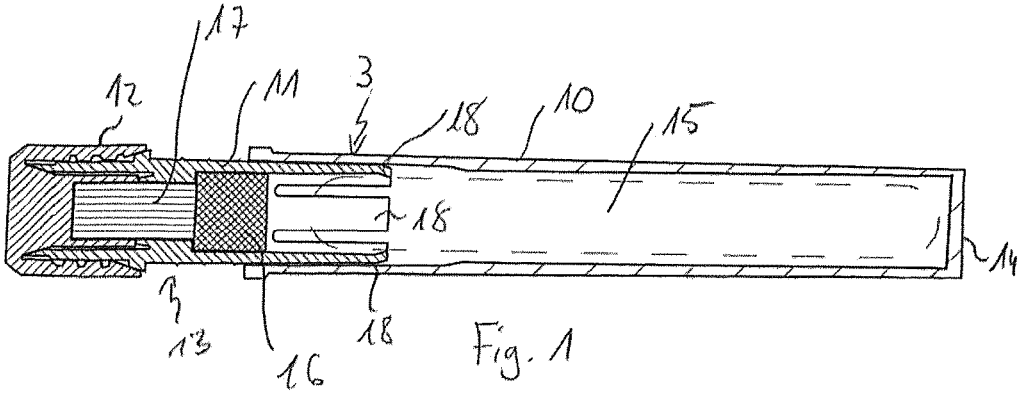
FIG. 1 shows a schematic sectional view of a first embodiment.
Figure 5:
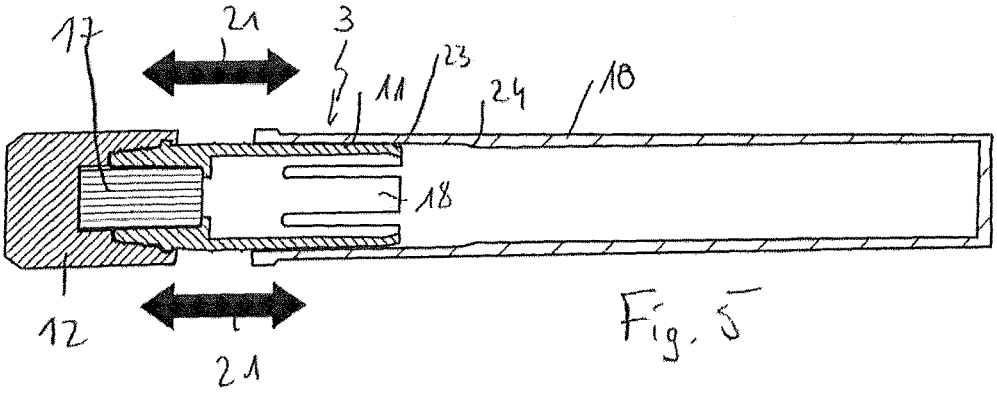
FIG. 5 shows a schematic sectional view of a second embodiment of the invention.
Figure 6:
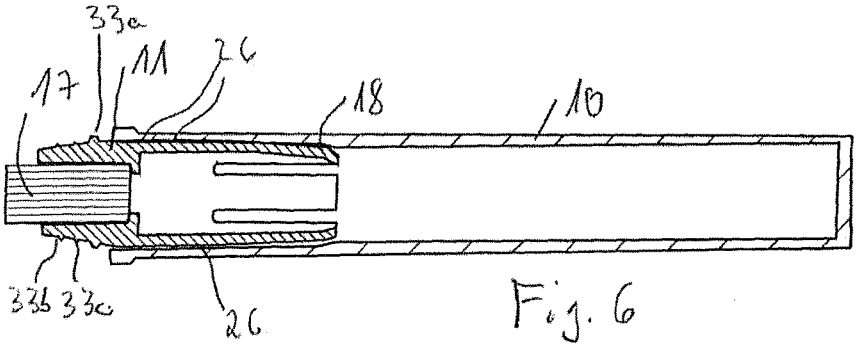
FIG. 6 shows a schematic section of the embodiment according to FIG. 5 and a different position without a cap.
Figure 7:
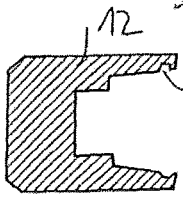
FIG. 7 shows a schematic section of the cap according to the embodiments according to FIGS. 5 and 6.

FIG. 5 shows a schematic sectional view of a second embodiment of the (in a first position). FIG. 6 shows the embodiment according to FIG. 5 without the closure cap. The ampoule is not shown in FIGS. 5 and 6 for the sake of simplicity, however is arranged in an analogous manner to FIG. 1. The mechanism for breaking the ampoule corresponds to the mechanism according to FIGS. 1 to 4 and is not explained again here. In contrast to the embodiment according to FIGS. 1 to 4, no sponge 16 is provided in the embodiment according to FIGS. 5 to 7. In the embodiment according to FIGS. 5 to 7, the liquid applicator felt 17 prevents the glass splinters being able to escape from the ampoule. To this end, the liquid applicator felt 17 is not integrated in the cap 12 (cf. FIGS. 6 and 7) unlike in the embodiment according to FIGS. 1 to 4, but in the head part 11. Analogous to the embodiment according to FIGS. 1 to 4, the head part 11 is sealed in relation to the basic body 10 by sealing rings 26. Said sealing rings 26 can be realized as sealing lips or sealing lamellae. In addition, an outer circumferential face of the head part 11, which is located opposite an inner circumferential face of the cap 12, also comprises sealing rings 33*a* to 33*c*. The sealing ring 33*a* (see FIG. 7) engages in a corresponding ring-shaped recess (groove) 34 on an inner circumferential face of the cap 12 for realizing a latching connection. The sealing rings 33*b*, 33*c* are realized as sealing lips (sealing lamellae) which improve the sealing further. The cap 12 according to the embodiment according to FIGS. 5 to 7 is fitted onto the head part 11, a connection being realized as a result of latching.

Figure 8:
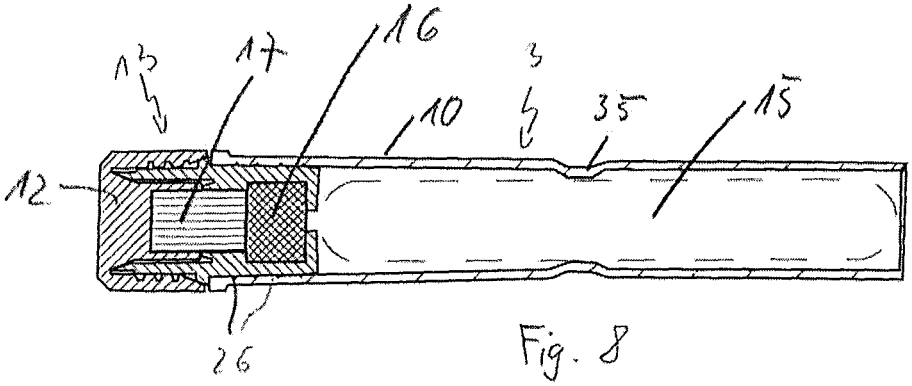
FIG. 8 shows a sectional representation of a third embodiment of the invention.
Figure 9:
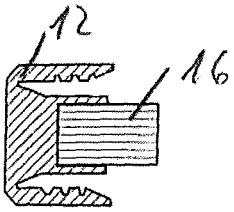
FIG. 9 shows a schematic sectional view of a cap according to the embodiment according to FIG. 8.

FIG. 8 shows a schematic sectional view of a third embodiment of the application pen. The third embodiment according to FIGS. 8 and 9 corresponds to the first embodiment according to FIGS. 1 to 4 (in particular with regard to the sealing between the head part 11 and the basic body 10 or the head part 11 and the closure cap 12 as well as with regard to the liquid applicator felt 7 and the sponge 16) with the following differences. In the case of the embodiment according to FIGS. 8 and 9, the ampoule 15 is broken by a ring-shaped constriction which provides a predetermined bending point. On account of the ring-shaped constriction 35, the basic body 10 can be bent such that the ampoule 15 breaks. As can be seen in FIG. 9, the liquid applicator felt 17 is arranged inside the closure cap 12 in the case of the third embodiment analogous to FIG. 4.

Figure 10:
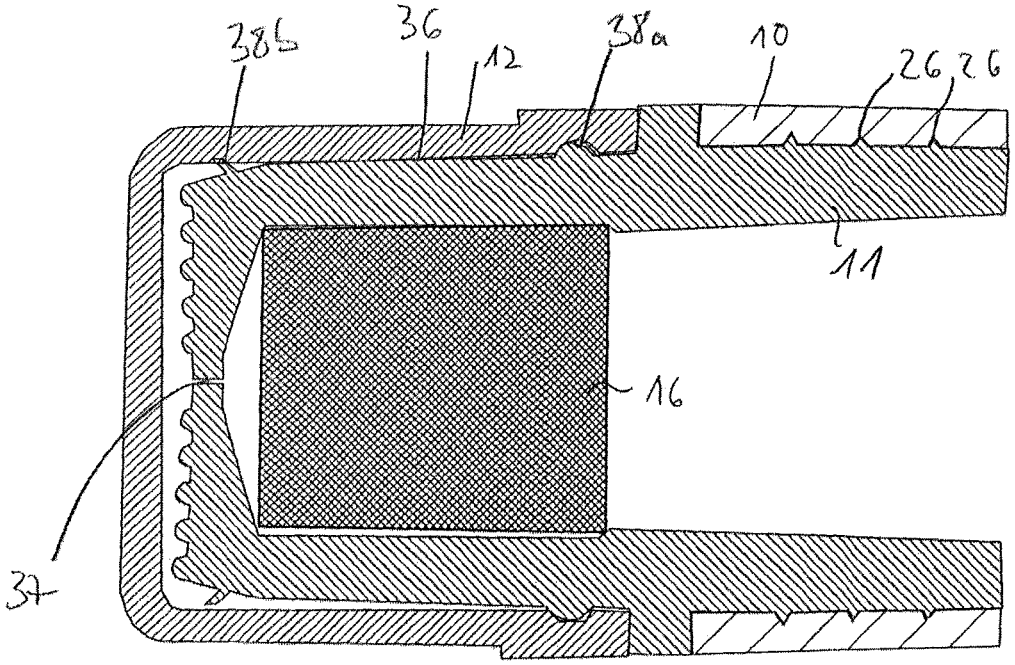
FIG. 10 shows a schematic section of a detail of a fourth embodiment of the invention.
Figure 11:
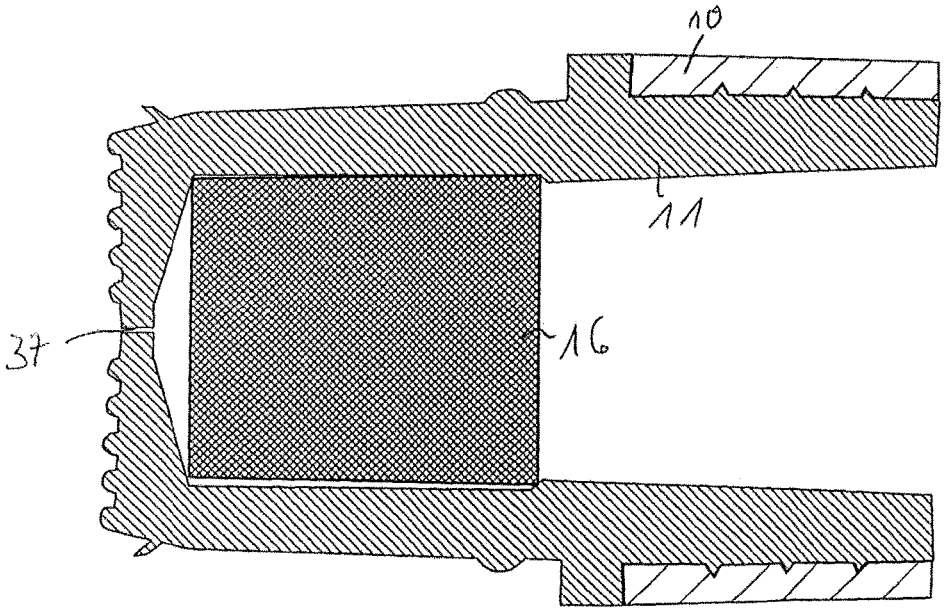
FIG. 11 shows the detail of the embodiment according to FIG. 10 without a closure cap.

FIGS. 10 and 11 show a schematic sectional view of a detail of a fourth embodiment of the invention. The parts of the fourth embodiment not shown, in particular in so far as this relates to the basic body 10 and the mechanism of the breaking of the ampoule, can be realized as in the first, second or third embodiment (or in a combination of said embodiments). In contrast to the preceding embodiments, no liquid applicator felt is provided in the embodiment according to FIGS. 10 and 11. Splinters are prevented from falling out of the ampoule by the sponge 16 which additionally sucks up and absorbs liquid. In order to be able to use the application pen according to FIGS. 10 and 11, first of all the (preferably transparent) cap 12 has to be removed (see FIG. 11). As a result of pressing onto a circumferential face 36 of the head part 11 in the region of the sponge 16, liquid is ejected through a slot 37 according to the "baby bottle" principle. The sealing between the head part 11 and the basic body 10 is effected by means of sealing lips 26, as in the embodiment according to FIGS. 1 to 4. The cap 12 is sealed in relation to the head part 11 by means of sealing rings 38*a*, 38*b*, the sealing ring 38*a* engaging in a corresponding annular groove 39 on an inner circumferential face of the cap 12 for realizing a latching connection. The sealing ring 38*b* is realized as a protruding sealing lamella.

Figure 12:
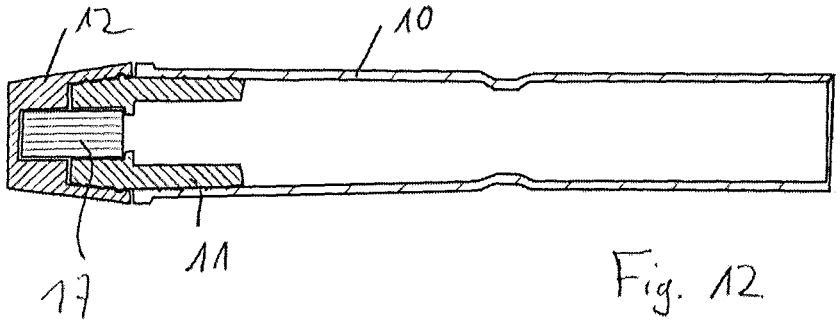
FIG. 12 shows a schematic section of a fifth embodiment of the invention.
Figure 13:
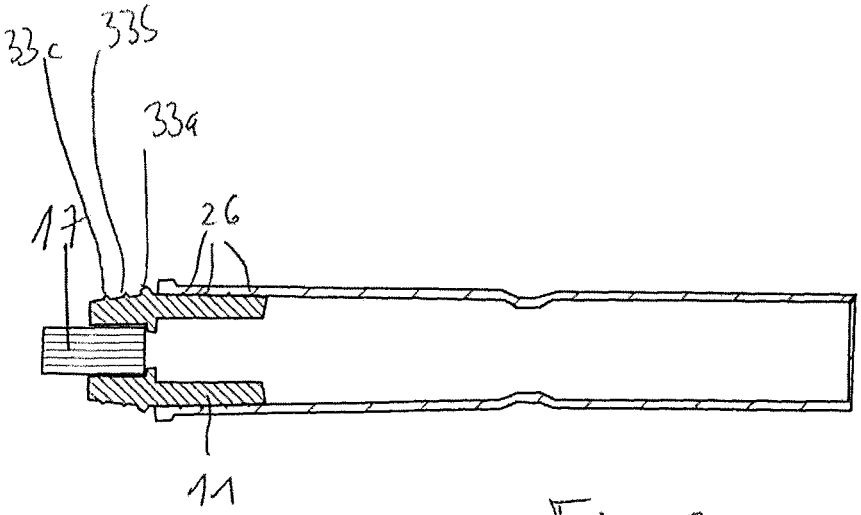
FIG. 13 shows the embodiment according to FIG. 12 without a closure cap.

FIGS. 12 and 13 show sectional views of a fifth embodiment of the invention (FIG. 12 with closure cap; FIG. 13 without closure cap). The mechanism of breaking the ampoule corresponds to the mechanism as is described in the case of the embodiment according to FIGS. 8 and 9. A sponge is not provided, but rather a liquid applicator felt 17. Analogous to the embodiment according to FIGS. 5 and 6, said liquid applicator felt remains in the head part 11 which comprises sealing lips 26 analogously to the preceding embodiments in order to realize sealing between the basic body 10 and the head part 11. In addition, analogously to the embodiment according to FIGS. 5 to 7, sealing rings 33*a* to 33*c* are provided in order to enable latching of the closure cap 12 as well as sealing between the closure cap 12 and the head part 11.

Figure 2:
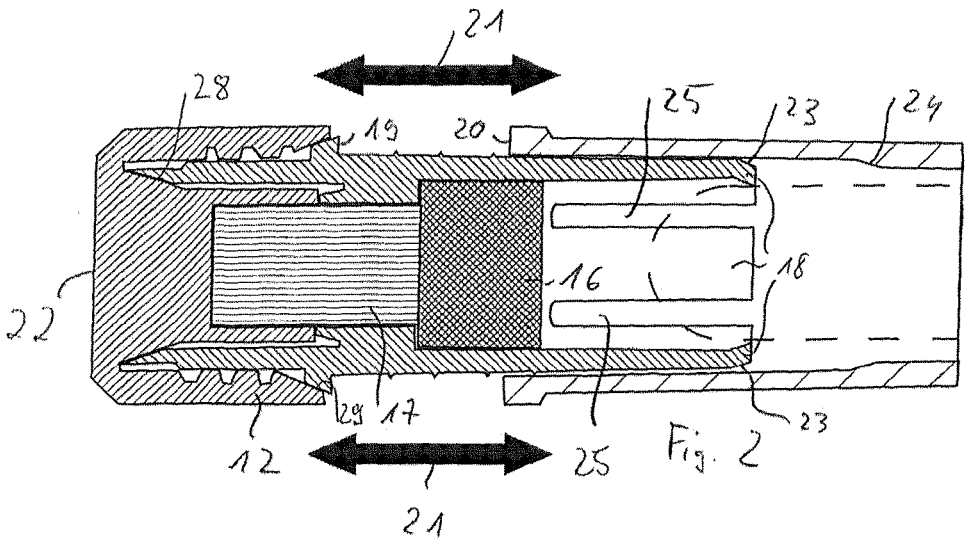
FIG. 2 shows a sectional view of an enlarged detail of the embodiment according to FIG. 1.

In the embodiment according to FIGS. 1 to 4 as well as 5 to 7, a circumferential foil element (not shown) can be arranged preferably as a label in a region between the end stops 19 and 20 (see FIG. 2). If this label is removed, the end stops 19 and 20 are able to be moved toward one another.

In principle, in the case of all the embodiments (where applicable with structural adaptations) the respective cap 12 can be screw-connected or fitted (positioned) onto the head part 11.

The sponge 16 can be, for example, a melamine sponge or can be produced from another plastics material. In general, the sponge 16 can be formed from a foam material. The ampoule 15 can consist, for example, of glass. The basic body and/or the head part and/or the closure cap 12 can be formed from a plastics material, for example polyamide, polyethylene or polypropylene (generally polyolefin).

In principle, the application pen is used for applying liquids onto all types of surfaces. A preferred application is the applying of a liquid as an adhesion-promoting substrate or as a protection layer in the region of connecting faces (for example in the automobile sector when inserting panes).

The liquid applicator felt 17 can generally be an arbitrary liquid applicator part. The liquid applicator felt can consist of fibres that are randomly arranged or of fibres that are aligned in the direction of the fluid.

Figure 14:
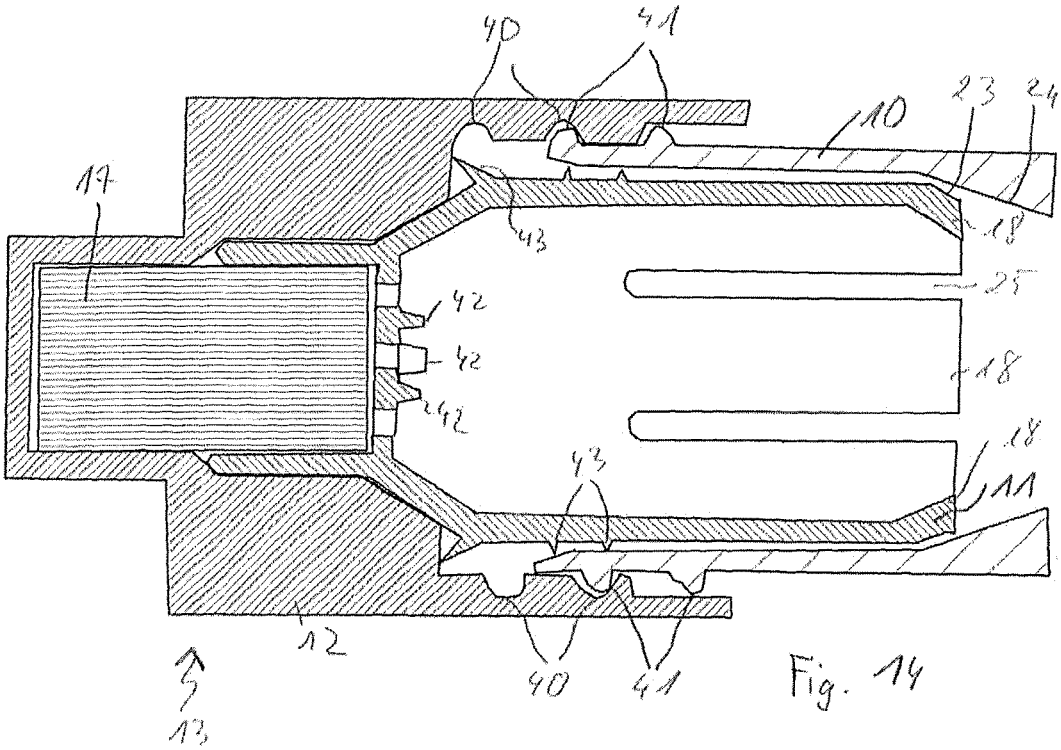
FIG. 14 shows a schematic section analogous to FIG. 2 of a detail of a sixth embodiment of the invention.
Figure 15:
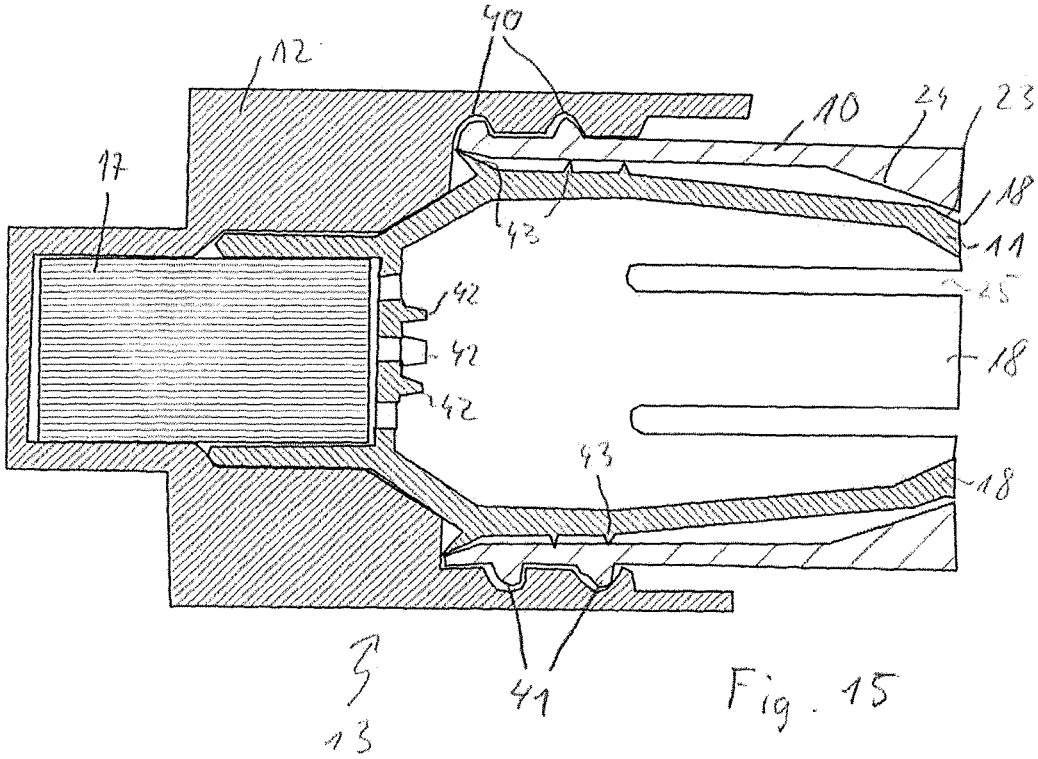
FIG. 15 shows a schematic section analogous to FIG. 3 of a detail of the embodiment according to FIG. 14.

FIGS. 14 and 15 each show a detail of a sixth embodiment of the application pen. FIG. 14, in this case, shows a detail analogous to FIG. 2. FIG. 15 shows a detail analogous to FIG. 3. In contrast to the embodiment according to FIGS. 2 and 3, the head part 11 (the movable portion) is not moved by means of an axially acting impact, but by a rotation of the cap 12. To this end, the cap 12 comprises a thread 40 (which is preferably realized as an internal thread). The basic body 10 comprises s corresponding thread 41 (which is preferably realized an external thread) such that the closure cap 12 can be moved by rotation in the direction of the basic body 10. As a result, the head part 11 is also urged in the direction of the basic body 10 such that the run-up inclination 23 of the head part 11, analogous to the embodiment of FIGS. 2 and 3, runs up against the run-up inclination 24 of the basic body 10 such that the claws 18 are pressed inward and an ampoule, located between the claws 18 (not shown in FIGS. 14 and 15; cf. for example, FIG. 1), breaks. In addition, in the embodiment according to FIGS. 14 and 15, positioning journals 42 are still provided between the liquid applicator felt 17 and the ampoule (not shown in FIGS. 14 and 15) such that the ampoule can be positioned and supported before it is broken. The run-up inclinations 23, 24 together form an example of a deflecting device. The claws 18 and the run-up inclinations 23, 24 together form an example of a breaking device.

Apart from this, sealing rings (or sealing lips) 43 are provided between the head 11 and the basic body 10.

LIST OF REFERENCES

3 Hollow body
10 Basic body
11 Head part (movable portion)
12 Closure cap
13 Outlet region
14 Rear end
15 Ampoule
16 Sponge
17 Liquid applicator felt
18 Claw
19 End stop
20 End stop
21 Arrow
22 End
23 Run-up inclination
24 Run-up inclination
25 Slot
26 Sealing ring
27 Screw-type thread
28 Cone portion
29 Cone portion
30 Ring-shaped inclined face
31 Ring-shaped inclined face
32 Recess
33*a*-33*c* Sealing ring
34 Annular groove
35 Ring-shaped constriction
36 Circumferential face
37 Slot
38*a*, 38*b* Sealing ring
39 Annular groove
40 Thread of the cap 12
41 Thread of the basic body 10
42 Positioning journal
43 Sealing rings or lips

The invention claimed is:

1. Application pen for dispensing a liquid onto a surface, said application pen comprising:

a hollow body for receiving a liquid inside an ampoule, wherein the ampoule is configured to be broken for discharging the liquid, wherein the hollow body includes at least one closure cap as well as a basic body, wherein the closure cap includes a liquid applicator part, wherein the closure cap with the liquid applicator part is configured to be removable from the basic body, and wherein the closure cap is configurable in a closed state on the application pen such that, when the closure cap is in the closed state on the application pen, the closure cap covers an axial end of the liquid applicator part, wherein the hollow body contains the basic body and one head part, and wherein the head part includes a flexible end face with a slot.

2. Application pen according to claim 1, wherein the liquid applicator part includes a liquid applicator felt, and with the cap removed, protrudes at least in part from the closure cap.

3. Application pen according to claim 1, the liquid applicator part comprising:

a porous body, which is configured to include a liquid applicator felt or which consists of a liquid applicator felt.

4. Application pen according to claim 1, wherein the liquid applicator part is fixedly connected to the closure cap, and is plugged in and/or pressed in and/or glued on and/or welded on.

5. Application pen according to claim 1, wherein an end of the closure cap remote from the liquid applicator part comprises:

a recess, and/or the closure cap comprises axially extending ribs on its outer circumferential face.

6. Application pen according to claim 4, comprising:

a breaking device with an axially movable portion configured such that a movement of the axially movable portion in an axial direction will result in the ampoule being broken during operation.

7. Application pen according to claim 6, wherein the axially movable portion is arranged to be movable in the axial direction onto an end of the application pen as a result of an impact that is carried out in the axial direction such that the ampoule breaks, and/or wherein a rotatable portion is configured such that a rotation of the rotatable portion will drive the movable portion, during operation, in the axial direction such that the ampoule breaks.

8. Application pen according to claim 7, wherein the breaking device comprises:

a deflecting device configured in such a manner that a force which acts axially on account of movement of the movable portion will be deflected, during operation, in a direction of a circumferential face of the ampoule.

9. Application pen according to claim 8, wherein the breaking device comprises:

at least one claw, arranged such that the claw will be driven, during operation, against the circumferential face of the ampoule as a result of the axial movement of the movable portion.

10. Application pen according to claim 1, wherein the hollow body comprises:

at least two parts, wherein at least one sealing ring is provided on at least one face of one of the parts, which is facing a face of a further part.

11. Application pen according to claim 1, wherein a width of the slot is no larger than 1 mm, and/or wherein a length of the slot is at least 1.5 mm and the length of the slot is no longer than 10 mm.

12. Application pen according to claim 1, wherein the ampoule is received in the hollow body.

13. Application pen according to claim 1, wherein the liquid is selected for a protection layer of an adhesion surface.

14. Application pen according to claim 1, wherein the liquid applicator part includes a liquid applicator felt which, with the cap removed, protrudes at least in part from the closure cap by at least 2 mm.

15. Application pen according to claim 1, wherein the liquid applicator part includes a liquid applicator felt which, with the cap removed, protrudes at least in part from the closure cap by at least 4 mm.

16. Application pen according to claim 9, wherein the claw is a flexible claw.

17. Application pen according to claim 10, wherein the hollow body comprises:

three parts, the sealing ring being a sealing lip provided on a circumferential face of one of the parts facing a circumferential face of a further part.

18. Application pen according to claim 1, wherein a width of the slot is no larger than 0.5 mm, and/or wherein a length of the slot is at least 2 mm and the length of the slot is no longer than 5 mm.

19. Application pen according to claim 1, wherein a width of the slot is no larger than 0.2 mm, and/or wherein a length of the slot is at least 2 mm and the length of the slot is no longer than 5 mm.

* * * * *